US005339552A

United States Patent [19]

Kolton et al.

[11] Patent Number: 5,339,552

[45] Date of Patent: Aug. 23, 1994

[54] BELT AND INDICATOR ASSEMBLY AND METHOD FOR USE IN BELT MANUFACTURE

[75] Inventors: Chester Kolton, Westfield; Stuart S. Spater, Livingston, both of N.J.

[73] Assignee: B&G Plastics, Inc., Newark, N.J.

[21] Appl. No.: 960,941

[22] Filed: Oct. 14, 1992

Related U.S. Application Data

[63] Continuation-in-part of Ser. No. 817,750, Jan. 7, 1992.

[51] Int. Cl.[5] ..... G09F 23/00

[52] U.S. Cl. ..... 40/640; 40/299

[58] Field of Search ..... 40/640, 299, 633, 638; 2/311; D2/627–629, 624–626; 24/163 K

[56] References Cited

U.S. PATENT DOCUMENTS

| | | | |
|---|---|---|---|
| 743,984 | 11/1903 | Knothe | D2/627 X |
| 1,825,045 | 9/1931 | Blickhahn | 40/640 |
| 1,882,475 | 10/1932 | Blickhahn | 40/640 |
| 3,043,037 | 7/1962 | Lesser et al. | 40/640 |
| 3,513,575 | 5/1970 | Schiller | 40/640 |
| 4,651,989 | 3/1987 | Wilson | D2/629 X |

*Primary Examiner*—Kenneth J. Dorner
*Assistant Examiner*—Milton Nelson, Jr.
*Attorney, Agent, or Firm*—Robin, Blecker, Daley & Driscoll

[57] ABSTRACT

A marketing indicator arrangement for application to a belt comprises a strip member having first and second opposed ends and an adhesive layer disposed on a first side of the strip member at the first end thereof, the strip member being comprised of a material selected so as not to take a permanent set upon coiling of a belt with the strip member retained therewith. A method for providing a plurality of marketing indicators each of a predetermined first width involves the steps of providing a substrate widthwise of a dimension which is at least a multiple of the predetermined first width and having opposed first and second ends, applying a support member to the substrate widthwise thereof at the first substrate end, applying marketing information to the substrate between the first and second ends thereof in repetitive information sets widthwise of the substrate, and then subdividing the substrate widthwise thereof at intervals of the predetermined first width.

5 Claims, 7 Drawing Sheets

BELT AND INDICATOR ASSEMBLY AND METHOD FOR USE IN BELT MANUFACTURE

CROSS-REFERENCE TO RELATED APPLICATION

This application is a continuation-in-part of application Ser. No. 817,750, filed on Jan. 7, 1992.

FIELD OF THE INVENTION

This invention relates generally to improved practices in garment manufacture and pertains more particularly to methods for use in belt making and belt-indication assemblies resulting from such methods.

BACKGROUND OF THE INVENTION

For purposes of indicating marketing parameters, e.g., belt manufacturer, price, size and the like, the conventional practice prior to the improvement set forth in the '750 patent application was to use a so-called "swift tag" involving a plastic filament which is passed through an opening in a tag bearing the marketing parameters and through one of the prong receiving openings of the belt blank and then secured at filament ends to remain with the belt until the filament is cut apart at checkout.

The swift tags with plastic filament have tendencies, as discussed in the '750 patent application, where belts are hung adjacently, to snag with adjacent belt counterparts undermining the display effort. Also, where the swift tags are applied at the point of belt making, they tend undesirably, to become entangled with one another in the course of packaging, shipping and unpacking.

The '750 patent application provides a method for use in belt making wherein a marketing indicator is secured with the belt at the time of the assembly of the belt blank and the belt buckle.

More particularly, in making belts having buckles of the type having a prong pivotally supported by an arm of the buckle frame, following the step of applying a belt-retaining loop member to the belt blank and buckle disposed therewith, a portion of a marketing indicator is applied to the undersurface of the belt blank, interiorly of the boundary of the subsequent stitching, thereby to be secured with the stitched assembly.

When the stitching is performed, as is customary, in an inverted disposition of the belt blank, the '750 practice looks to retentive application of the marketing indicator to the undersurface of the belt blank. To this end, the portion of the indicator which is disposed interiorly of the stitching, or at least a part of such portion, has an adhesive backing applied thereto for securement thereof to the belt blank. Accordingly, upon inversion of the belt blank, the indicator remains with the belt blank, without assembler assistance.

While the member attached with the heretofore known belt assembly has above been referred to as itself a marketing indicator, it is more often the case that marketing information is not assigned or known at the point of belt making, but is to be assigned at a subsequent juncture. To accommodate such situation, the '750 method contemplates that the attached member be a blank which is receptive to a subsequently applied marketing indicator, desirably having an adhesive backing for retentive application to the blank and sized to be within the borders of the exposed area of the blank, i.e. that area not within the stitching.

In a still further aspect, the '750 practice affords improved removability of belt marketing indicators. Thus, it will be appreciated that the belt stitching which secures the assembly imparts perforations to the marketing indicator facilitating its removal by tearing across the line of perforations.

In commercially implementing the '750 practice, applicants have provided the marketing indicators individually successively on a reel which is rotatably supported adjacent a belt assembler's work station, such that the assembler may take an individual indicator from the reel and apply the indicator to the belt blank.

It is customary in the belt industry to coil belts for shipping, i.e., to wind the belt into a spiral configuration, with the belt buckle nested interiorly of the spiral. The spiral typically encompasses a plurality of belts, one coiled about its predecessor in the plurality.

While the described marketing indicator and practice have enjoyed commercial success, a nominal shortcoming of the '750 practice in this respect is that the coiling of belts imparts curvature to the marketing indicators and the curvature sets in the indicators and is at hand in the final assembled belt and indicator when the belt is uncoiled for display, i.e., the free end of the indicator becomes displaced outwardly of the belt blank, to be in potential interference with an adjacently-hung belt in retail establishments and to be aesthetically undesirable.

SUMMARY OF THE INVENTION

The present invention has as its objective improvements to the methods and marketing indicators of the '750 patent application.

In one of its aspects, the invention overcomes the shortcoming above-noted in the provision of marketing indicators so as to avoid setting of coil-induced curvature in the indicators.

In attaining this object, the invention provides a marketing indicator arrangement for application to a belt comprising a strip member having first and second opposed ends and an adhesive layer disposed on a first side of the strip member at the first end thereof, the strip member being comprised of a material selected so as not to take a permanent set upon coiling of a belt with the strip member retained therewith.

In another of its aspects, the subject invention provides a method for making a plurality of indicators each with marketing indication imprinted thereon.

In attaining this object, the invention provides a method for providing a plurality of marketing indicators each of a predetermined first width involves the steps of providing a substrate widthwise of a dimension which is at least a multiple of the predetermined first width and having opposed first and second ends, applying a support member to the substrate widthwise thereof at the first substrate end, applying marketing information to the substrate between the first and second ends thereof in repetitive information sets widthwise of the substrate, and then subdividing the substrate widthwise thereof at intervals of the predetermined first width.

The foregoing and other objects and features of the invention will be further understood from the following detailed description of preferred embodiments thereof and from the drawings, wherein like reference numerals identify like components throughout.

DETAILED DESCRIPTION OF PREFERRED EMBODIMENTS AND PRACTICES

Figure 1:
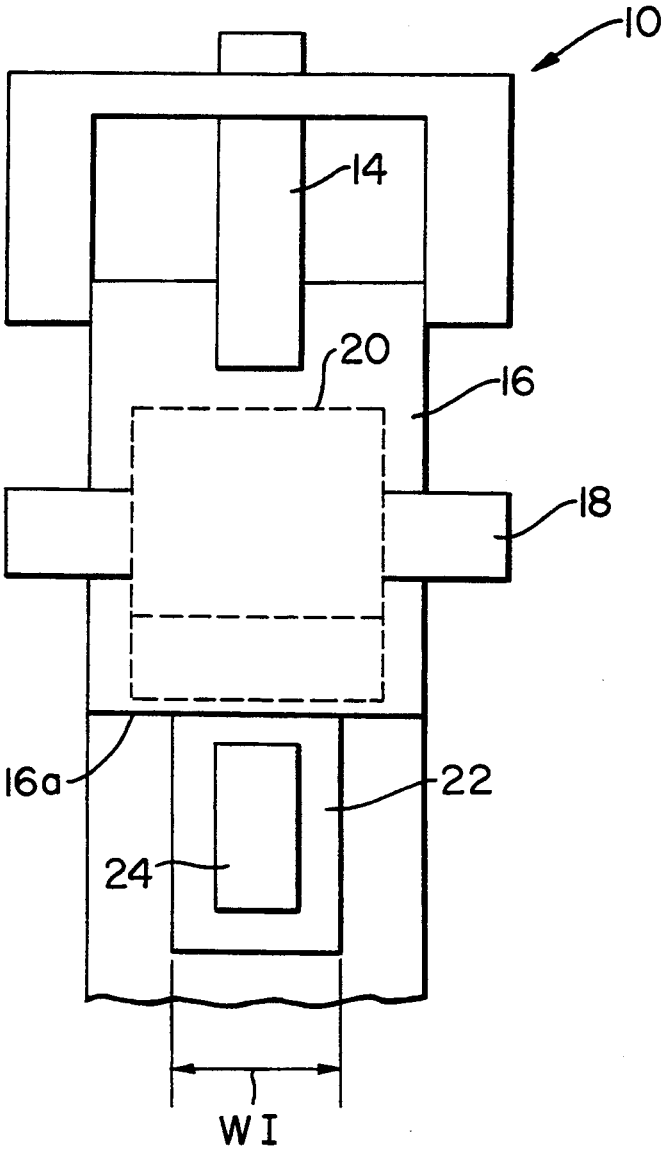
FIG. 1 is an underside plan view of a first belt making practice and assembly in accordance with the invention.
Figure 2:
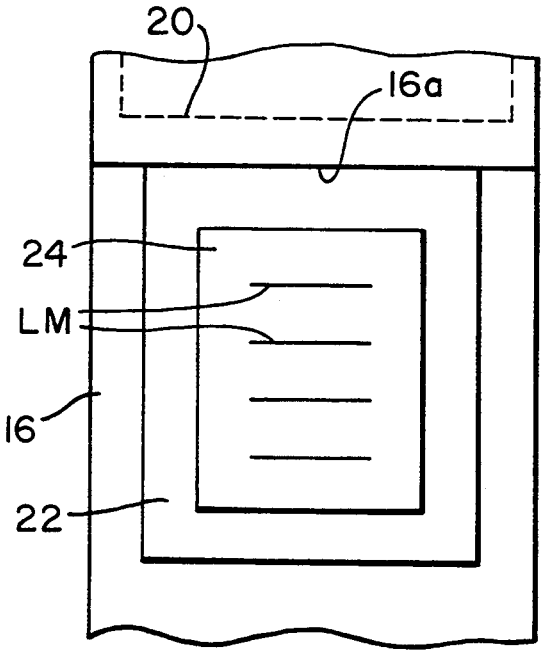
FIG. 2 repeats a portion of FIG. 1 with marketing indication lines shown on the marketing indicator.
Figure 3:
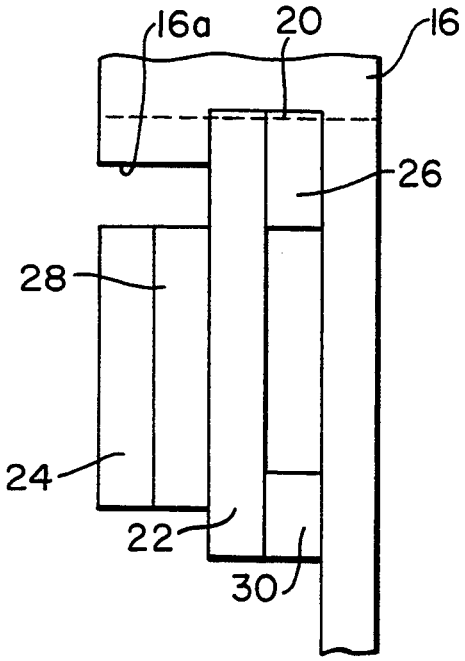
FIG. 3 is a right side elevation of FIG. 2.

Referring to FIGS. 1–3, individual parts therein include belt buckle 10 comprised of frame 12 and prong 14, pivotally supported on lower course 12*a* of frame 12, belt blank 16 which defines a prong through-aperture (not shown) and and has end course 16*a*, and belt-retaining loop member 18. Further components include indicator strip 22 and marketing indicator element 24, having respective adhesive layers 26 and 28 thereon. As indicated schematically in FIG. 2, element 24 may include lines of marketing indicia indicated as LM.

Per the '750 patent application method, prior to practice of the prior art step of applying belt-retaining loop member 18 to belt blank 16, a portion of indicator strip 22 is applied to the undersurface of belt blank 16 at a location known to be interior of the boundary of the subsequent stitching 20. In this step, adhesive layer 26 maintains the indicator strip securely with the belt blank, freeing the assembler of this task and may be practiced with the belt not yet in receipt of its buckle and not yet folded, as desired.

When sewing is subsequently performed to form stitching 20, it will be seen from FIG. 3, that a course of the stitching, i.e., the lowermost stitching course, encompasses a portion of indicator strip, perforating the same. As above alluded to, it will be appreciated that the belt stitching which secures the assembly imparts perforations to the marketing indicator facilitating its removal by tearing across the line of perforations, which can be done at the facility checkout station.

While the member attached with the heretofore known belt assembly has above been described as comprising an indicator strip, receptive of a marketing indicator element, the latter to be applied to the belt at the point of belt making, it is sometimes the case that marketing information is known at the point of belt making, rather than being assigned at a subsequent juncture. Marketing indicator 22' of FIGS. 5 and 6 is for use in the latter instances, marketing indicia LM being applied directly thereto, as discussed hereinafter.

Figure 4:
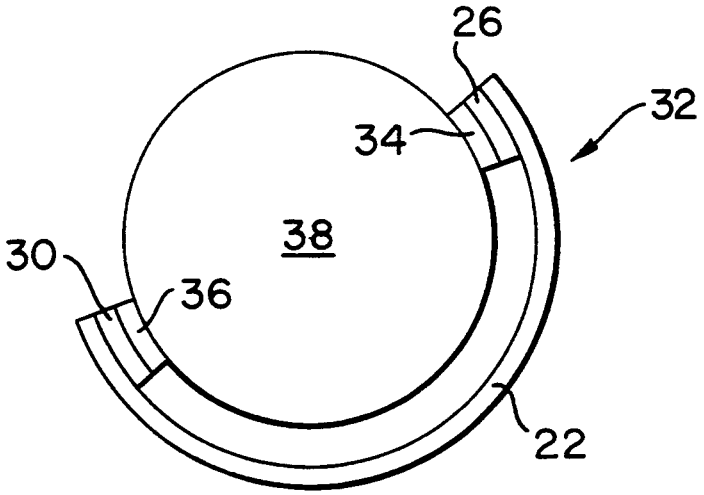
FIG. 4 is an elevation of a portion of a reel for dispensing marketing indicators per the invention.
Figure 5:
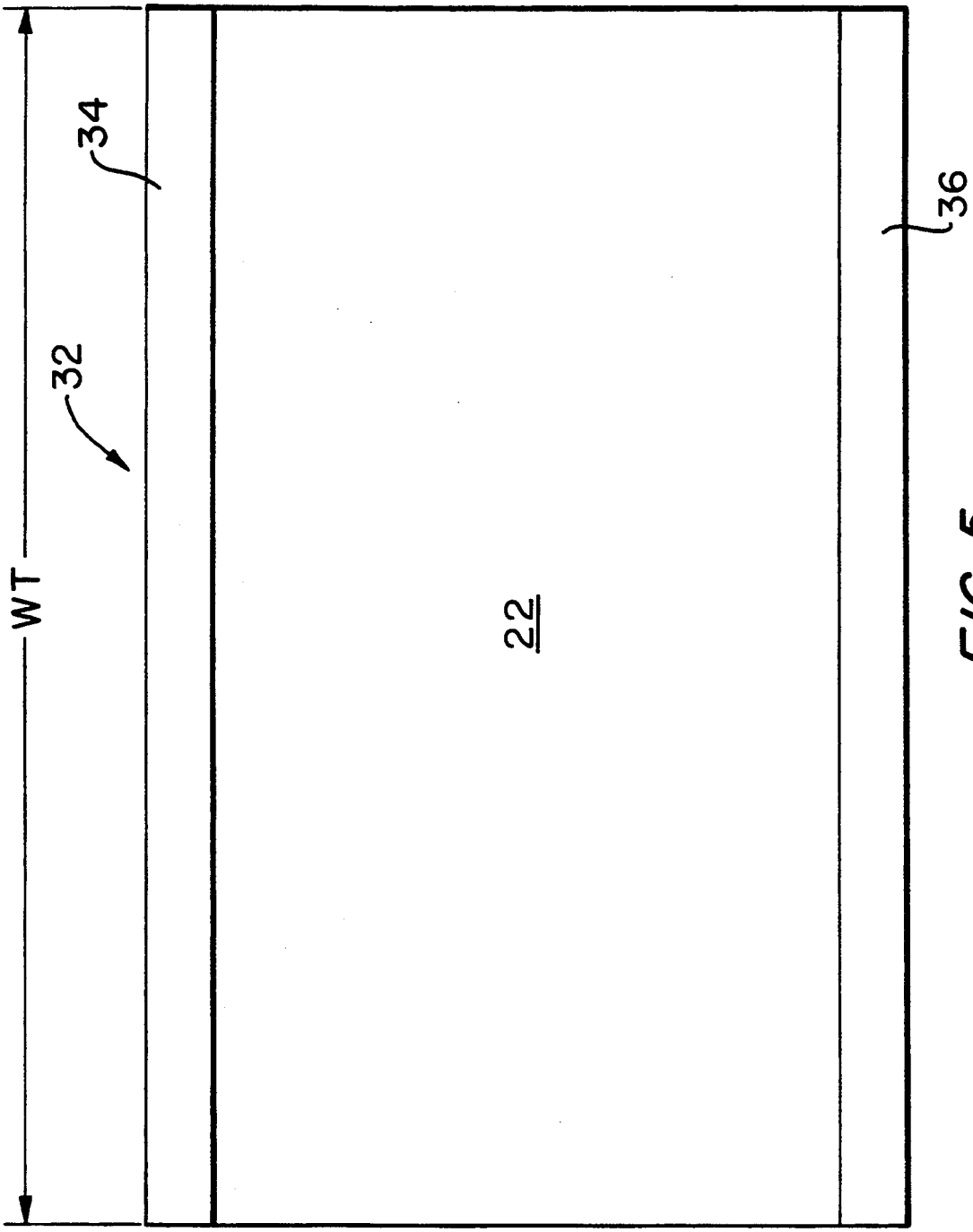
FIG. 5 is a left side elevation of FIG. 4.

In FIGS. 4 and 5, a reeled marketing indicator arrangement 30 includes a drum D having wound thereon marketing indicators 22', with their adhesive underlayers 26 and a support member 32. Reeled arrangement 30 is disposed adjacent a belt making station and an operator simply peels indicators from support member 32 and applies them to belts as above discussed, with adhesive layer 26 retaining the indicator with the belt blank.

Figure 6:
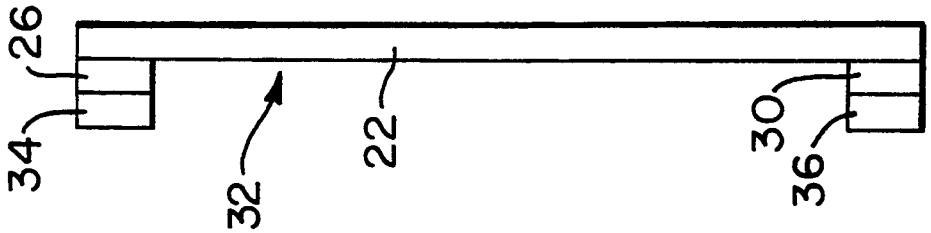
FIG. 6 is an underside view of a starting assembly for making a plurality of marketing indicators per the invention.
Figure 7:
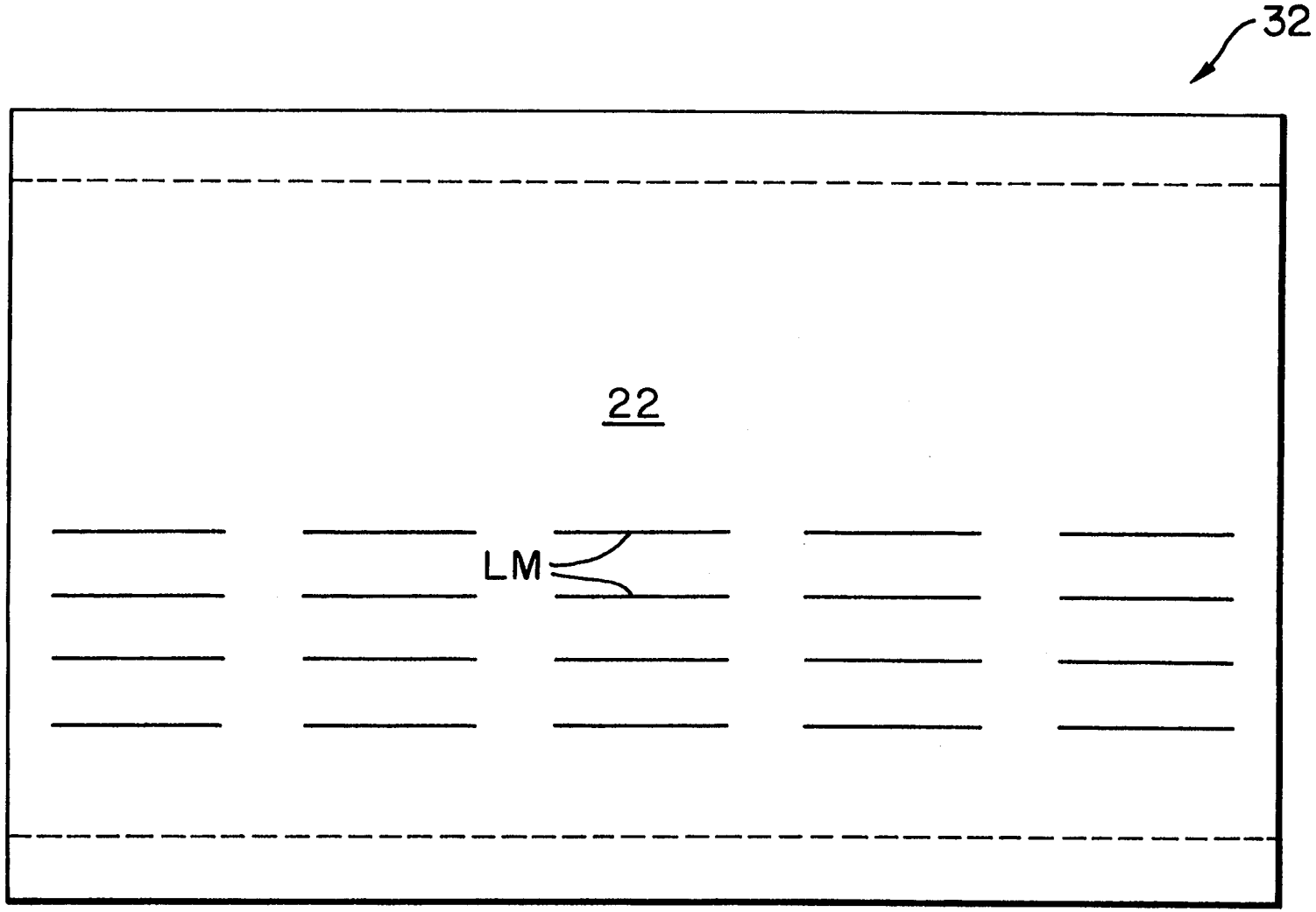
FIG. 7 is a right side elevation of FIG. 6.

FIGS. 6 and 7 show a starting assembly 34 for manufacture of a plurality of marketing indicators. Starting substrate 36 has a width WT, which is a multiple, e.g., five, of that of an individual marketing indicator width WI, shown in FIG. 1. Support member 32 extends continuously widthwise of substrate 36 and adhesive layer 26 secures substrate 36 to support member 32.

Figure 8:
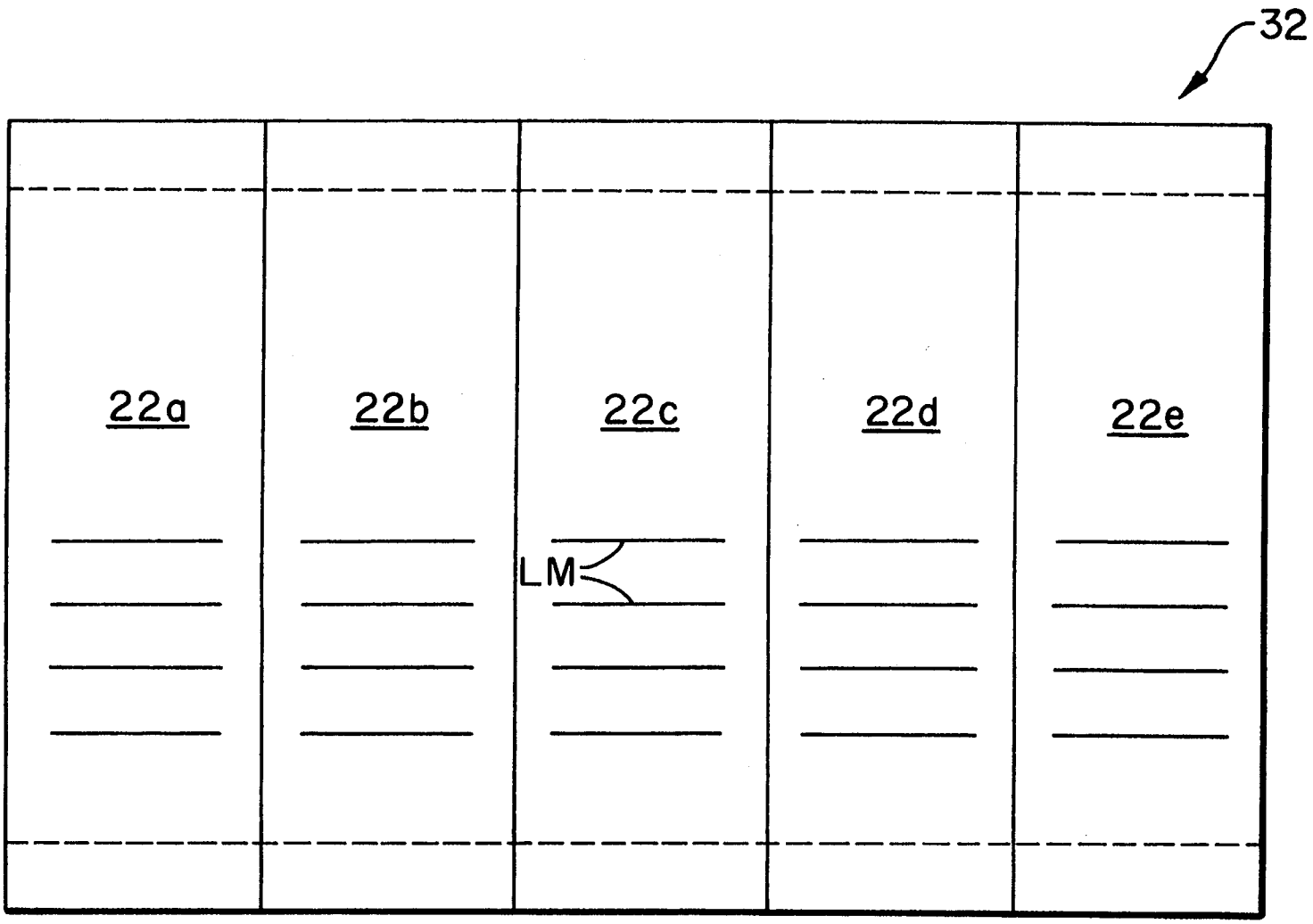
FIG. 8 is a top side view of the FIG. 7 starting assembly after being subjected to imprinting with marketing information, indicated by the vertical line sets occurring repetitively widthwise of the assembly.

In accordance with the present invention, substrate 36 is imprinted with marketing information as is shown in FIG. 8, i.e., integral widthwise. The results of the imprinting, shown in FIG. 8, the marketing information being indicated by the vertical line sets LM occurring repetitively widthwise of the substrate.

Figure 9:
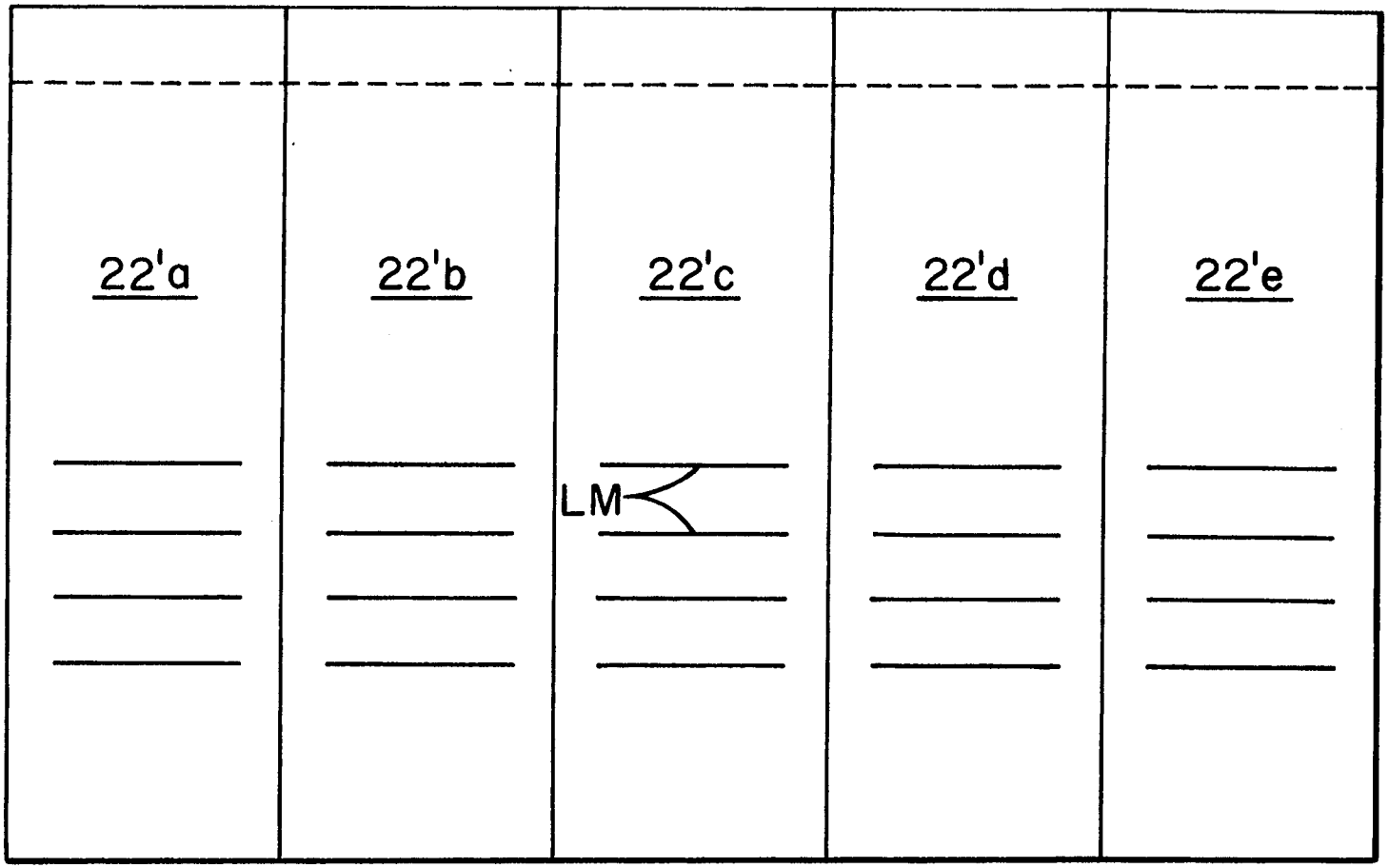
FIG. 9 is a a top side view of the FIG. 8 assembly after being subjected to cutting.
Figure 10:
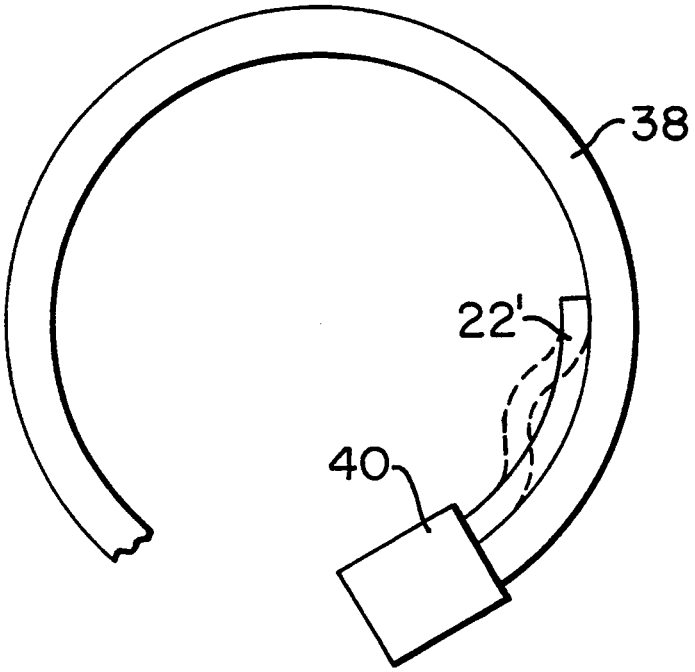
FIG. 10 is a partial plan view of a belt coiling condition.

In further practice in accordance with the present invention, substrate 36, in its FIG. 8 condition, is slit or cut to define individual or discrete marketing indicators 22'a through 22'e (FIG. 9). The slits are made only through the substrate and its adhesive backing 26, and not through support member 32, whereby the latter fully supports the discrete indicators, permitting reeling thereof.

As above alluded to, it is customary in the belt industry to coil belts for shipping, i.e., to wind the belt into a spiral configuration, with the belt buckle nested protectively interiorly of the spiral. The spiral typically encompasses a plurality of belts, one coiled about its predecessor in the plurality. Referring now to FIG. 9, belt 38 has buckle 40 and marketing indicator 22' secured therewith and would represent the interiormost coiled belt in the wound belt plurality. As is seen, indicator 22' is forced into arcuate shape by the coiled belt 38, the indicator adopting the curvature of the coiled belt. Such condition of the indicator persists from the point of coiling until uncoiling, which may be a quite substantial time period, involving time in inventory at the belt manufacturer and belt seller and shipping time. The curvature sets in the indicators and is at hand in the final assembled belt and indicator when the belt is uncoiled for display, i.e., the free end of the indicator becomes displaced outwardly of the belt blank, to be aesthetically undesirable and to be in potential interference with an adjacently-hung belt in retail establishments.

In a preliminary effort to address this difficulty, applicants looked to the use of a second adhesive layer, i.e., disposed beneath the free end of the indicator. However, such was not a solution, since as indicated by the phantom lines in FIG. 9, coiling of the belt gave rise to disturbance of the indicator, since it was fixed at both of its ends.

A successful solution was found by applicants in looking to the use of a material for the indicator which would give the indicator a resistance to permanent setting under coiling conditions.

In an outset effort in the search for a suitable material, polyolefin films were investigated and found not to have such memory as to revert to an original flat condition after being placed in an arcuate condition and maintained so for a given time period. Further investigation led applicants to polyester films, both translucent and opaque. Quite suitable materials were identified as Mylar® Type A 48-1400 Guage, available from DuPont Polyester Film Enterprise, Wilmington, Del. and Melenex® 329, available from ICI Films, Wilmington, Del. The latter material is an opaque, white film and is directly imprintable to retain marketing indicia on its surface. Translucent films may likewise be used with an indicator label applied thereto. Per the subject invention, the marketing indicator material is thus selected such that the marketing indicator does not take a permanent set upon coiling of a belt blank with the marketing indicator retained therewith and both identified materials meet such selection requirement.

Various changes in structure to the described marketing indicator and practices connected therewith may evidently be introduced without departing from the invention. Accordingly, it is to be understood that the particularly disclosed and depicted embodiments and practices are intended in an illustrative and not in a limiting sense. The true spirit and scope of the invention is set forth in the following claims.

What is claimed is:

1. In combination:

(a) a belt blank having a prong-passage opening therethrough at a location distal from a first end of said belt blank, said belt blank being folded onto itself to have said belt blank first end upon said belt blank;

(b) a belt buckle having a prong pivotally supported on an open frame of said buckle, said belt buckle being within said fold of said belt blank, with said prong extending through said prong-passage opening of said belt blank;

(c) a belt-retaining loop member secured to said folded belt blank and in circumscribing relation thereto; and (d) a marketing indicator having at least a portion thereof disposed retentively with respect to said belt blank at a location within said fold of said belt blank, said marketing indicator having opposed first and second ends, said marketing indicator being comprised of a material selected such that said marketing indicator does not take a permanent set upon coiling of said belt blank with said marketing indicator retained therewith.

2. The structure claimed in claim 1, wherein said securing means includes an adhesive element securing said marketing indicator first end to said belt blank.

3. The structure claimed in claim 1 wherein said securing means comprises stitching extending through said folded belt blank, said buckle, said marketing indicator and said belt-retaining loop member.

4. The structure claimed in claim 1 wherein said marketing indicator comprises a strip member which is receptive to the imprinting of marketing indicia directly thereon.

5. The structure claimed in claim 1 further comprising a marketing indicia element applied to said marketing indicator strip member.

* * * * *